US006913802B1

(12) United States Patent
Plant

(10) Patent No.: US 6,913,802 B1
(45) Date of Patent: Jul. 5, 2005

(54) ENERGY ABSORBING PROTECTIVE MEMBER

(76) Inventor: Daniel James Plant, 1A Basement Flat 215 York Mansions Earls Court, London (GB), SW5 9AF ( * ) Notice: Subject to any disclaimer, the term of this patent is extended or adjusted under 35 U.S.C. 154(b) by 0 days.

(21) Appl. No.: 09/959,888

(22) PCT Filed: May 12, 2000

(86) PCT No.: PCT/GB00/01832

§ 371 (c)(1),
(2), (4) Date: Nov. 13, 2001

(87) PCT Pub. No.: WO00/69293

PCT Pub. Date: Nov. 23, 2000

(30) Foreign Application Priority Data

May 12, 1999 (GB) ..... 9911056

(51) Int. Cl.[7] ..... B29D 22/00; B29D 23/00; B32B 1/08

(52) U.S. Cl. ..... 428/35.2; 428/35.7; 428/36.5; 428/36.1; 428/71; 428/76; 428/152; 428/176; 428/178; 428/182; 428/185; 428/308.4

(58) Field of Search ..... 428/35.2, 34.1, 428/35.7, 36.1, 76, 71, 156, 152, 161, 162, 163, 117, 174, 176, 178, 179, 182, 185, 186, 188, 308.4, 304.4, 36.5

(56) References Cited

U.S. PATENT DOCUMENTS

| | | | | | |
|---|---|---|---|---|---|
| 3,649,426 | A | | 3/1972 | Gates | 161/43 |
| 3,663,973 | A | * | 5/1972 | Spence | 5/348 |
| 4,864,737 | A | * | 9/1989 | Marello | 36/29 |
| 5,090,053 | A | | 2/1992 | Hayes | 2/2 |
| 5,138,722 | A | | 8/1992 | Urella et al. | 2/209 |
| 5,274,846 | A | * | 1/1994 | Kolsky | 2/2 |
| 5,507,866 | A | | 4/1996 | Drew et al. | 106/287.1 |
| 5,599,290 | A | * | 2/1997 | Hayes et al. | 602/61 |
| 5,854,143 | A | | 12/1998 | Schuster | 442/135 |

* cited by examiner

*Primary Examiner*—Harold Pyon
*Assistant Examiner*—Michael C. Miggins
(74) *Attorney, Agent, or Firm*—Young & Thompson

(57) ABSTRACT

A protective member primarily for use as an energy absorbing pad for incorporation into garments to protect the wearer against accidental impacts. The member comprises a putty-like energy absorbing material (2) encapsulated in a flexible envelope (3, 4). The energy absorbing material is normally soft and flexible but changes to become temporarily rigid when an impact force is applied thereto, thereby absorbing the impact energy, the material returning to its normal flexible condition after the impact. The energy absorbing member preferably comprises a series of connected corrugations to increase its energy absorbing properties.

20 Claims, 5 Drawing Sheets

ENERGY ABSORBING PROTECTIVE MEMBER

BACKGROUND OF THE INVENTION

This invention relates to a new energy absorbing member which is particularly applicable for protection and is especially suitable for incorporation into garments or apparel worn by people who need their body parts protected against impact. The protective member can also be mounted on an object such as a door frame or wall edge which a person might accidentally come into contact with.

The protective member of the invention is particularly applicable for use in the medical field, by sportsmen, motor cyclists, urban street wear (cycling/rollerblading), work wear, body armour, riot police gear, oil riggers gear or film crews etc. as well as many other applications such as in crash barriers or as an energy absorbing wall or floor covering.

One established way of absorbing and/or spreading impact energy is to make a pad out of an energy absorbing material. Such pads are generally made of foam and are either worn by the person who needs protection or attached to the part of the fixture likely to be impacted. Static pads can be flexible or rigid as they do not need to bend in use. In some applications, a rigid pad is worn by the wearer. For instance, as a shin pad in the case of a rugby or soccer player or a forearm pad in the case of a cricketer as neither of these limb parts need to bend or articulate in use. However, where a joint needs to be protected, a high degree of flexibility is required so the protective pads need to be made of a flexible material to give the wearer the required level of mobility to make the pad comfortable to wear.

Body impact protection currently available is limited because it is either based on a rigid exterior shell (for example as used as roller blade pads) or upon some form of foam laminate (as used in ski pant inserts). However, foam laminates provide poor levels of protection and rigid shells are uncomfortable to wear.

A protective member is known from U.S. Pat. No. 5,138,722 in which an energy absorbing material is contained in an envelope, the material remaining soft and flexible until it is subjected to an impact when its characteristics change rendering it temporarily rigid. The shape of the envelope however is not very efficient at absorbing and quickly dissipating the impact energy.

SUMMARY OF THE INVENTION

It is an object of the present invention therefore to provide a protective member which more effectively absorbs and spreads impact energy and is soft and flexible yet has high energy absorbing properties. It is a further object of the invention to provide an energy absorbing member which can be permanently attached and tailored into a garment or part thereof.

According to the invention there is provided a protective member comprising an energy absorbing material in an envelope, the material remaining soft and flexible until it is subjected to an impact when its characteristics change rendering it temporarily rigid, the invention being characterised in that the envelope is formed with at least one convolution having an apex directed towards the direction of said impact force whereby the impact force applied to the apex is absorbed as the material becomes rigid, the material returning to its normal flexible condition after said impact.

Preferably the energy absorbing material is encapsulated in the envelope and absorbs the impact force and spreads the load thereof during the duration of the impact. Preferably the energy absorbing material is a strain rate sensitive material such as a dilatent compound whose mechanical characteristics change on impact.

The preferred material is a Dimethyl siloxane hydroterminated polymer such as the material sold by DOW CORNING under their Catalogue or Trade number 3179.

The encapsulating envelope can be made of foam, fabric, plastic, rubber or metal or a combination of these materials, to contain the energy absorbing material and prevent egress thereof from the envelope. The envelope is however preferably made from an elastomer which conveniently is thermo plastic. A thermoplastic polyester elastomer preferably having a crystalline PBT (polybutylene terephthalate) hard segment with an amorphous glycol soft segment has been found to be particularly suitable. The preferred material is the thermo plastic elastomer sold by Dupont under their Trade Mark HYTREL.

The encapsulating envelope can be substantially planar but is preferably corrugated along its length. The angle of the sides of each corrugation is not critical but 54° has been found to give excellent energy absorbing results.

The encapsulating envelope has an outer and inner surface and, a flexible foam layer can be attached to said inner surface. For some uses, the foam layer may be attached to only one surface or both the inner and outer surfaces.

In another embodiment, the protective member is a channel shaped segment which is arcuate along its length. A plurality of these segments can be joined together to form a sheet of protective material with the longitudinal axis of one segment at 90° to an adjacent segment. In order to form the sheet, the corners of each segment are connected to the corners of a contiguous segment.

BRIEF DESCRIPTION OF THE DRAWINGS

Several embodiments of the invention will now be described, by way of example only, with reference to the accompanying drawings, in which.

DETAILED DESCRIPTION OF THE PREFERRED EMBODIMENTS

Figure 1:
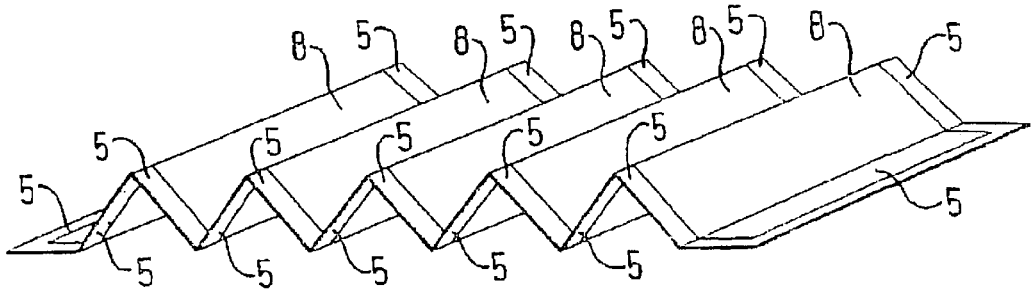
FIG. 1 is a perspective view of one form of protective member of the invention.
Figure 2:
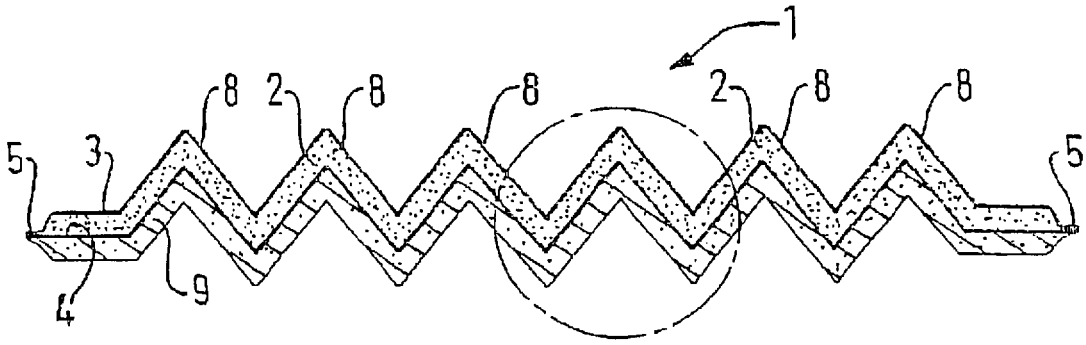
FIG. 2 is a cross section through the corrugated protective member of FIG. 1.

FIGS. 1 and 2 show a protective member 1 of the invention which comprises a quantity of energy absorbing material 2 encapsulated in an envelope comprising an upper layer 3 and a lower layer 4 connected together at their periphery 5 to provide a sealed enclosure for the material 2.

The envelope can however be blow moulded from a single piece of material.

The energy absorbing material 2 can be a strain rate sensitive polymer, a non-Newtonian fluid or a dilatent compound which is normally malleable under low strain rates and behaves in a manner similar to a putty like substance. However, when an impact is applied to the material 2, it momentarily changes from being malleable and instantaneously becomes rigid thereby absorbing and spreading the impact energy. The preferred material is a dimethyl siloxane hydroterminated polymer such as the material manufactured by DOW CORNING and sold under their catalogue or trade No. 3179.

The encapsulating layers 3 and 4 are preferably made of a thermo plastic elastomer material manufactured by Du Pont and sold under their trade mark HY-TREL. This material is strong enough to withstand the impact energy without the material tearing or fracturing but at the same time allows the impact energy to be transferred through the material layer 3,4 to be absorbed by the putty-like energy absorbing material 2.

This unique multi-layer energy absorbing member can flex with movement of the body when protection is not needed and thus is very comfortable to wear. When impacted however, the strain rate sensitive polymer in the energy absorbing member reacts instantaneously to form a semi-rigid structure that absorbs and dissipates the blow giving maximum protection. Independent tests have confirmed that the energy absorbing member of the invention is substantially more effective than conventional foam and/or plastic systems.

The Active Protection System (APS) of the invention has been impact tested and the results compared with identical impact tests carried out on a known impact protection member sold to motorcyclists under the trade mark "Dianese". In order to record the magnitude of pressure and force distribution on impact, a special film is used which changes colour in accordance with the level of impact pressure that it receives.

In order to carry out the test, a piece of Dianese and APS of the invention were impacted in a comparative test.

It was found that the APS energy absorbing member of the invention performed significantly better than the known "Dianese" pad because only very light grey areas are visible on the inside surface of APS member whereas substantial black areas are visible on the inside surface of the Dianese member. This clearly demonstrates that the APS member of the invention provides a much higher level of protection as comparatively very little force has passed through to its inside surface.

Figure 3:
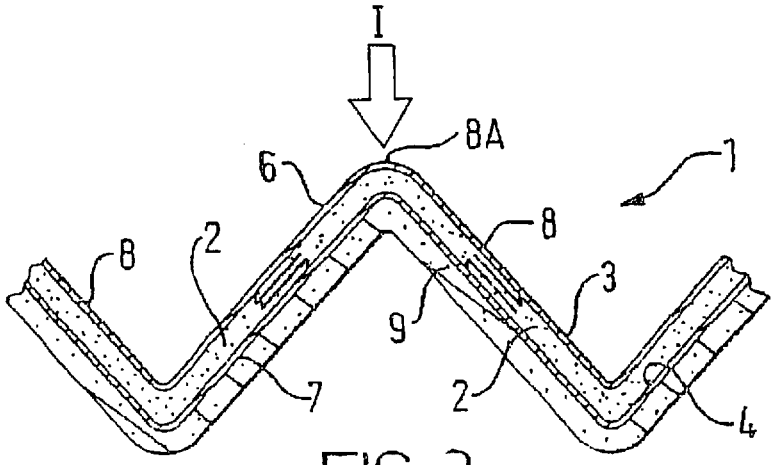
FIG. 3 is an enlarged view of the portion of the protective member circled in FIG. 2.

The energy absorbing member shown in FIGS. 1–3 has a corrugated configuration with a plurality of convolutions 8 along its length to increase its energy absorbing properties. The energy absorbing material 2 is encapsulated between sheets 3 and 4 made of HY-TREL which are sealed at 5 around their periphery to contain the material 2 within the envelope (see FIG. 2). To increase its energy absorbing properties and also for increased comfort, a layer of foam 9 can be attached to inner layer 7 of membrane 4. The envelope has to be of a thickness which is sufficient to enable it to return to its original configuration after impact. 0.5–1.5 mm has been found to be particularly satisfactory.

Referring now to FIG. 3, when an impact load I is applied to the energy absorbing member 1 in the direction of the arrow, the load I will be dissipated by the apexes 8A of the convolutions down either side thereof which creates shear fores as the material hardens thereby absorbing the impact load. Preferably the apixes 8A are curved rather than pointed as this further assists in dissipating the impact load I down either side of each of the corrugations 8.

It should be noted that the foam backing 9 is preferred rather than essential and is usually provided on the inner surface of the energy absorbing member for increased comfort for the wearer.

Figure 4:
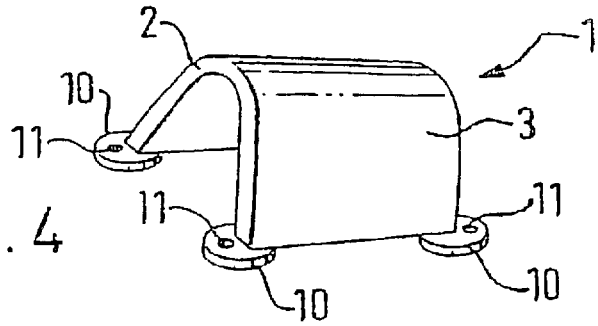
FIG. 4 is a view of a protective segment of the invention.
Figure 5:
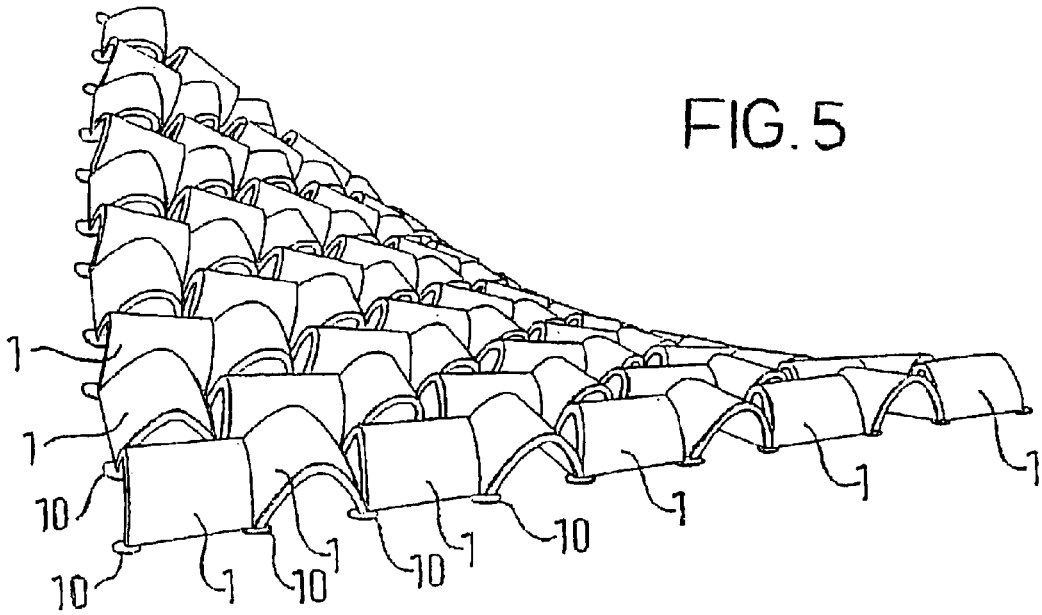
FIG. 5 is a view of a sheet of material made up from a plurality of interconnected protective segments shown in FIG. 4.

FIG. 4 shows an alternative form of energy member 1 in accordance with the present invention which is particularly suitable for use in making up a sheet of material as shown in FIG. 5. Each energy absorbing member 1 comprises an outer membrane 3 and an inner membrane 4 between which the putty-like energy absorbing material 2 is encapsulated. The energy absorbing member 1 can be channel or arch shaped and conveniently but not essentially has connecting means in the form of a foot or pad 10 at each corner thereof having a hole 11 therein. It can however be cone shaped or of any energy absorbing profile.

As can be seen more clearly in FIG. 5, the plurality of the channel shaped energy absorbing members 1 can be connected together for instance by means of their feet 10 to form a sheet of material which is flexible and bendable in several planes. Each energy absorbing member 1 of the sheet works in exactly the same way as the energy absorbing member just described in that when an impact load is applied to the sheet of material, the normally malleable energy absorbing material 2 within each member 1 temporarily becomes rigid thereby absorbing the load, the material 2 returning to its normal malleable state shortly after the impact energy has been absorbed.

The configuration of the sheet illustrated in FIG. 5 is only one example of the way in which a sheet of material can be formed using individual energy absorbing members 1 connected together with their longitudinal axis normal to each other. Other configurations are however possible.

Figure 6:
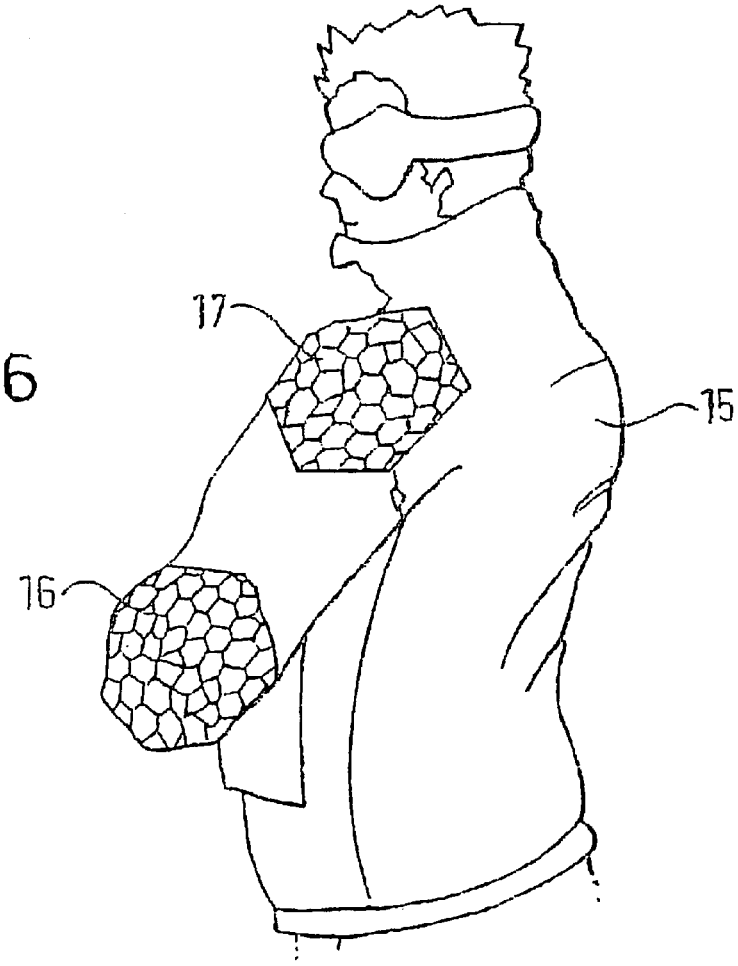
FIG. 6 is a perspective view of a person wearing a garment incorporating protective members of the invention.

A particularly useful application of energy absorbing members of the present invention is shown in FIG. 6 where an energy absorbing elbow pad 16 and a shoulder pad 17 is incorporated into garment 15. Similar pads can be incorporated into the knee, shin or thigh area of a pair of trousers (not shown).

Figure 7:
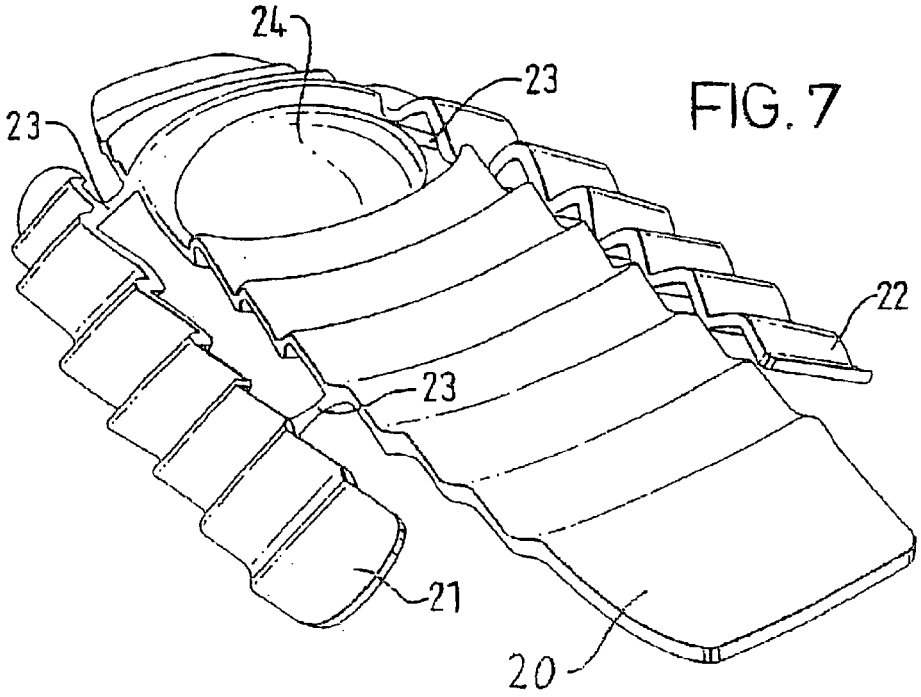
FIG. 7 is a view of another form of protective member of the invention for use as an elbow protector.

FIG. 7 shows a design of elbow pad in accordance with the present invention which comprises an elongate main body section 20 having optional out-riggers 21,22 attached to the main body section by means of spars 23. The main body section 20 has a dome shaped section 24 to receive the wearer's elbow joint. The energy absorbing member illustrated in FIG. 7 is of the same construction as the embodiments already described in that it comprises an energy absorbing putty-like material 2 encapsulated between inner and outer layers 3 and 4 made of HY-TREL. The main body section 20 and the out-riggers 21 are corrugated as illustrated and are therefore similar in construction to the protective member shown in FIGS. 2–5.

In use, the wearer would place the main body section 20 inside the garment sleeve with their elbow joint located within the dome shaped section 24. The elongate body section 20 would extend down the wearer's arm generally coaxial therewith and the out riggers 21 and 22 would be folded around the arm on either side thereof. Thus, the elbow region would be protected against direct impacts on the elbow joint itself and also the portions of the arm on either side of the elbow joint would be protected. The protective member shown in FIG. 9 can either by inserted within the wearer's sleeve for instance into a stretch pocket or alternatively can be attached to the fabric from which the garment is made as an integral part thereof, e.g. by stitching or thermal attachment.

Whilst the embodiment shown in FIG. 7 is an elbow pad, it will be appreciated that the design thereof could be changed while still operating in the same way to protect other body parts such as shoulders, knees or hips.

Figure 8:
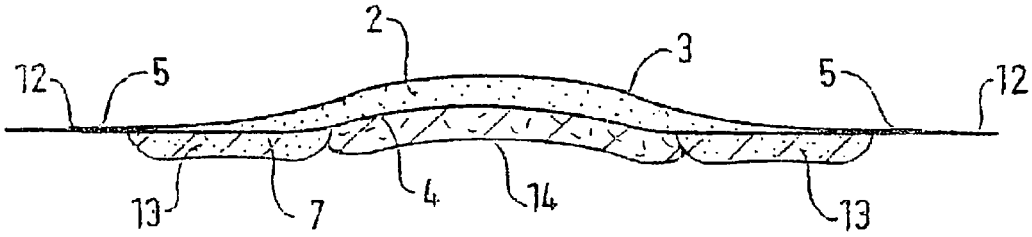
FIG. 8 is a cross sectional view of another form of protective member.
Figure 9:
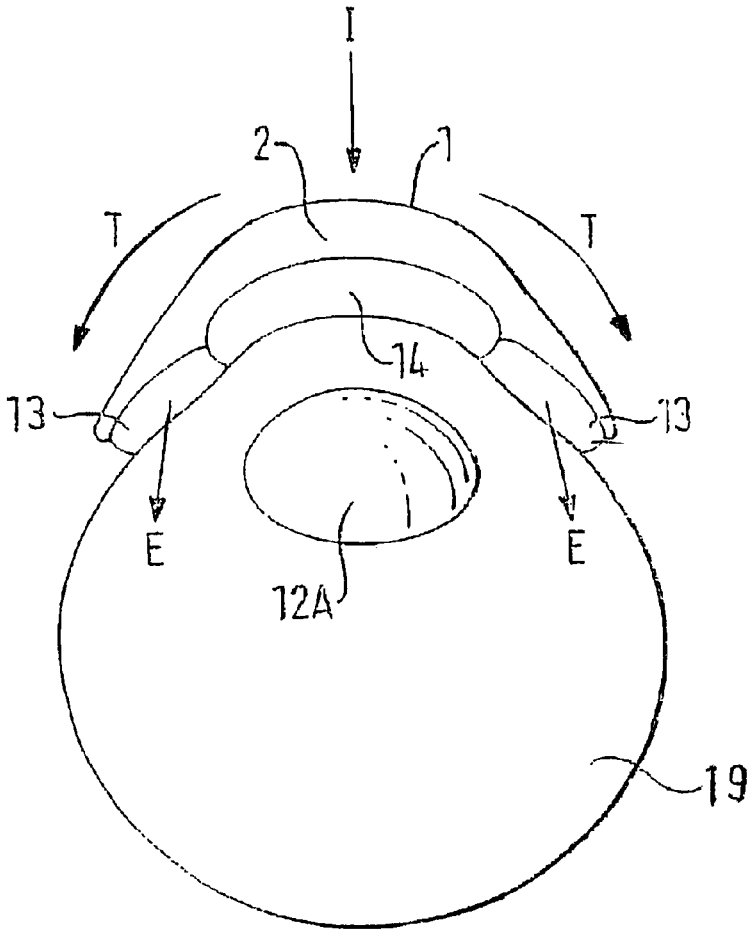
FIG. 9 is a view of the protective member of FIGS. 6 and 7 in position on a wearer's shin.

FIGS. 8 and 9 show a further embodiment of energy absorbing member 1 of the present invention which comprises a textile layer or tube 12 to which an energy absorbing pad of the invention is attached to protect, for example, a knee, elbow or hip joint. The energy absorbing member 1 comprises an outer layer 3 and an inner layer 4 preferably made of a material such as HY-TREL between which is encapsulated the putty-like malleable material 2. The edges of the layers 3 and 4 are preferably connected together at 5 to seal the putty-like material with the envelope 3. 4. The layers 3 and 4 can however be made of a textile material whose surfaces are coated, preferably with a water proofing material such as polyurethane or any other membrane which will encapsulate and contain the malleable material 2.

To assist its energy absorbing properties, an annular foam ring 13 can be attached to inner surface 7 of the membrane 4. A spacer 14 made from a textile material is preferably provided within the annular foam ring 13 to ensure that the putty layer 2 does not come into contact with the users limb to be protected.

As can be seen more clearly In FIG. 9, when the impact load I is applied to the energy absorbing member 1 fitted to a limb 12 of a wearer, the energy impact is initially dissipated laterally in the directions of arrows T thereby deflecting the impact load I away from the wearer's shinbone 12A. The initial impact is absorbed by the putty-like material 2 which changes from its malleable state to its rigid state but the load is then transferred laterally to the outer edges of the member 1 where it is absorbed as load E in the foam ring 3 and the soft skin or muscle of the wearer's limb 12. It will be appreciated that the energy absorbing member just described and illustrated moves the impact force I away from the bone 12A and into layer 3 and the fatty tissue in the leg. The energy absorbing member 1 can be shaped to include the convoluted sections 8 shown in FIGS. 1–3 or 7.

The Active Protection System (APS) of the invention protects the human body from abrasions and impacts. This flexible system can be incorporated directly into a garment. The APS is malleable under normal conditions and will easily conform to the movements of the body and is therefore non-restrictive. Upon impact the APS becomes momentarily rigid, spreading and absorbing the impact force before returning to its normal flexible, comfortable state.

The APS is made from two materials combined in layers. The heart of the system is the active strain rate sensitive polymer material 2 which reacts to impact, and is encapsulated in the flexible outer sheath 3,4. The system has been designed to work synergistically producing a significant increase in impact performance, over and above that of either material in isolation.

To assist its energy absorbing properties, an annular foam ring 13 can be attached to inner surface 7 of the membrane 4. A spacer 14 made from a textile material is preferably provided within the annular foam ring 13 to ensure that the putty layer 2 does not come into contact with the users limb to be protected.

As can be seen more clearly in FIG. 9, when the impact load I is applied to the energy absorbing member 1 fitted to a limb (19 of a wearer, the energy impact is initially dissipated laterally in the directions of arrows T thereby deflecting the impact load I away from the wearer's shin bone 12A. The initial impact is absorbed by the putty-like material 2 which changes from its malleable state to its rigid state but the load is then transferred laterally to the outer edges of the member 1 where it is absorbed as load E in the form ring 13 and the soft skin or muscle of the wearer's limb 19. It will be appreciated that the energy absorbing member just described and illustrated moves the impact force I away from the bone 12A and into layer 3 and the fatty tissue in the leg. The energy absorbing member 1 can be shaped to include the convoluted sections 8 shown in FIGS. 3–5 or 9.

The Active Protection System (APS) of the invention protects the human body from abrasions and impacts. This flexible system can be incorporated directly into a garment. The APS is malleable under normal conditions and will easily conform of the movements of the body and is therefore non-restrictive. Upon impact the APS becomes momentarily rigid, spreading and absorbing the impact force before returning to its normal flexible, comfortable state.

The APS is made from two materials combined in layers. The heart of the system is the active strain rate sensitive polymer material 2 which reacts to impact, and is encapsulated in the flexible outer sheath 3,4. The system has been designed to work synergistically producing a significant increase in impact performance, over and above that of either material in isolation.

What is claimed is:

1. A protective member comprising:

a sealed envelope having a pair of spaced layers; and an energy absorbing material contained within said envelope, said energy absorbing material remaining soft and flexible until it is subjected to an impact force when its characteristics change rendering it temporarily rigid, both layers of said envelope being formed to include at least one convolution having an apex which, in use, absorbs said impact force when applied thereto due to said energy absorbing material becoming temporarily rigid, said energy absorbing material returning to its normal flexible condition after said impact wherein said energy absorbing material is selected from the group consisting of a strain sensitive polymer and a dilatent compound.

2. A protective member as claimed in claim 1 characterised in that the energy absorbing material (2) is encapsulated in the envelope (3,4).

3. A protective member as claimed in claim 1 characterised in that the energy absorbing material (2) is a dimethyl siloxane hydroterminated polymer.

4. A protective member as claimed in claim 1 characterised in that the envelope (3,4) has an inner face (7) to which a flexible foam layer (13) is attached.

5. A protective member as claimed in claim 1 characterised in that the envelope (3,4) is corrugated along its length and comprises a plurality of said convolutions (8).

6. A protective member as claimed in claim 5, characterised in that the angle of the sides of each convolution (8) is 54'.

7. A protective member as claimed in claim 1 characterised in that the envelope (3,4) is channel shaped and arcuate along its length to provide a protective segment (1).

8. A sheet of protective material made from a plurality of protective segments as claimed in claim 7, wherein said plural segments are connected together to form a sheet.

9. A sheet of protective material as claimed in claim 8 characterised in that each segment (1) has a longitudinal axis and one segment is connected to an adjacent segment with its longitudinal axis at 90° thereto.

10. A sheet of protective material as claimed in claim 8 characterised in that each segment (1) has means thereon to enable it to be connected to an adjacent segment, the edges of contiguous segments being joined together to form the sheet.

11. A sheet of protective member as claimed in claim 10 characterised in that the connecting means are feet (10).

12. A protective member as claimed in claim 1 characterised in that the envelope (3,4) is made of foam, fabric, plastic, rubber or metal or a combination of these materials, to contain the energy absorbing material (2) and prevent egress thereof from the envelope.

13.

14. A protective member as claimed in claim 1 characterised in that the envelope (3,4) is made of an elastomer.

15. A protective member as claimed in claim 14 characterised in that the elastomer is a thermoplastic elastomer.

16. A protective member as claimed in claim 15 characterized in that the elastomer is a polyester elastomer.

17. A protective member as claimed in claim 16 wherein the elastomer has a crystalline polybutylene terephthalate hard segment with an amorphous glycol soft segment.

18. A length of textile material with a protective member as claimed in claim 1 permanently attached thereto.

19. A garment or part thereof made from a textile material as claimed in claim 18.

20. A protective member comprising:

first and second spaced apart layers; and an energy absorbing material between said first and second layers, wherein both said first and second layers are corrugated, and wherein said energy absorbing material is normally flexible and becomes temporarily rigid upon an impact wherein said energy absorbing material is selected from the group consisting of a strain sensitive polymer and a dilatent compound.

* * * * *